US006257453B1

(12) United States Patent
Graham

(10) Patent No.: US 6,257,453 B1
(45) Date of Patent: Jul. 10, 2001

(54) TAMPER-INDICATING, TWO-PIECE DISPENSING CLOSURE

(75) Inventor: Paul R. Graham, Holland, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/526,799

(22) Filed: Mar. 16, 2000

(51) Int. Cl.[7] ..... B67D 5/00

(52) U.S. Cl. ..... 222/153.06; 222/153.02; 222/499; 222/522; 222/525; 222/541.6; 215/253; 215/311

(58) Field of Search ..... 222/153.02, 153.05, 222/153.06, 153.07, 499, 521–525, 541.6; 215/252–254, 311

(56) References Cited

U.S. PATENT DOCUMENTS

| | | | | |
|---|---|---|---|---|
| 2,775,369 | * | 12/1956 | Waite | 222/522 |
| 2,790,582 | * | 4/1957 | Halpern | 222/522 |
| 2,834,520 | * | 5/1958 | Nyden | 222/525 |
| 3,294,294 | * | 12/1966 | Amburgey | 222/525 |
| 3,521,796 | * | 7/1970 | Roy | 222/525 |
| 4,408,700 | | 10/1983 | Fillmore et al. | 222/522 |
| 5,104,008 | | 4/1992 | Crisci | 222/525 |
| 5,588,562 | | 12/1996 | Sander et al. | 222/153.06 |
| 5,655,685 | | 8/1997 | Carr et al. | 222/153.02 |
| 5,862,953 | | 1/1999 | Long, Jr. | 222/153.06 |

* cited by examiner

*Primary Examiner*—J. Casimer Jacyna

(57) ABSTRACT

A two-piece dispensing closure (20) for removable attachment to a neck (12) of a liquid container (10), the dispensing closure having a molded plastic cap member (22) with an annular skirt (32) that surrounds an upper free end portion of the container neck, a transversely extending top panel portion (26) spanning the annular skirt with an opening (28) positioned centrally thereof, and an annular spout (38) extending axially from the top panel in a direction opposed to the direction of the extent of the annular skirt from the top panel, the annular spout circumscribing the opening in the top panel. A separate, elongate valve member (24) is inserted into the spout of the cap member to be reversibly axially movable relative to the cap member, the valve member having an elongate central portion (40) that defines an annular dispensing passage (38) with an interior of the spout of the cap member and an enlarged grasping projection (42) at a free end of the valve member. The valve member (24) also has an annular extension (50) at an innermost free end thereof, the annular extension having a radial extent greater than the radial extent of an interior of the annular spout, to prevent inadvertent disengagement of the valve member from the cap member upon manual movement of the valve member from an innermost position, where it prevents dispensing of liquid from the container, to an outermost position, where it permits dispensing of liquid from the container.

12 Claims, 2 Drawing Sheets

TAMPER-INDICATING, TWO-PIECE DISPENSING CLOSURE

BACKGROUND OF THE INVENTION

1. Field of the Invention

This invention relates to a dispensing closure for removable attachment to a dispensing opening of a container. More particularly, this invention relates to a two-piece dispensing closure of the foregoing type with tamper-indicating opening characteristics.

2. Description of the Prior Art

U.S. Pat. No. 4,408,700 (Fillmore et al.), which was assigned to a predecessor of the assignee of the present invention, the disclosure of which is incorporated by reference herein, discloses a two-piece dispensing closure for attachment to the neck of a liquid containing container. The closure of this reference has a molded plastic cap with an annular opening in a top panel portion therein and an annular molded plastic valve telescopically inserted in the opening of the closure panel. The valve is slidable relative to the cap between an inner position of the valve, in which no dispensing of the contents of the container can occur, and an outer position of the valve, in which dispensing of the contents of the container can occur through the valve. Closures of this type have been widely used in the packaging of various non-comestible liquids, such as liquid detergents. and these packaging applications do not require tamper-indicating opening characteristics.

In the packaging of comestible liquids, however, such as sport drinks and other unpressurized beverages, it is desirable to provide a recloseable dispensing closure of the general type of the aforesaid '700 Patent to permit consumption of the contents of the container in doses that are much smaller than the capacity of the container. However, for these applications it is also important that the closure have tamper-indicating opening characteristics, both as to the attachment of the closure cap to the container and as to the telescopic fit between the closure valve and the closure cap, and the aforesaid '700 Patent does not disclose or suggest the inclusion of any structure that would impart the needed tamper-indicating opening characteristics to the closure described therein.

Another requirement for a two-piece dispensing closure for a comestible product is to provide a secure interference fit between the closure valve and the closure cap to prevent inadvertent disengagement of the valve from the cap during movement of the valve from its non-dispensing position to its dispensing position.

Other known prior art references relative to two-piece dispensing closure inventions are U.S. Pat. No. 5,104,008 (Crisci), U.S. Pat. No. 5,588,562 (Sander et al.), U.S. Pat. No. 5,655,685 (Carr et al) and U.S. Pat. No. 5,862,953 (Long, Jr.).

SUMMARY OF THE INVENTION

A dispensing closure according to the present invention is intended for application to a neck of a liquid container and is made up of a molded plastic cap member having an annular, transversely extending top panel member whose opening is surrounded by an annular spout that extends axially from the top panel member, the cap member further having an annular skirt extending axially from an edge of the top panel member in a direction opposed to the direction of the spout, the top panel member, annular spout and annular skirt being molded integrally in a single piece. The skirt is provided with an integral, inwardly extending helical thread to permit the dispensing closure to be removably affixed to a threaded neck of a bottle or other container. Of course, other modes of attachment of a closure to a container neck, such as a snap fit, are also contemplated. The dispensing closure further has a valve member that is slidable within the spout of the cap member between an innermost position of the valve member, where no dispensing of the liquid in the container can occur, and an outermost position of the valve member, where dispensing of the liquid in the container can occur through an annulus between the interior of the spout and the exterior of the valve member. An innermost end of the valve member is provided with an annular extension whose radial extent is greater than the radial extent of the opening of the spout. The annular extension has sufficient flexibility to permit the valve member to be forcibly inserted into the spout of the cap until it clears the interior of the spout and the top panel of the cap. However, the annular extension thereafter serves to help prevent inadvertent disengagement of the valve member from the cap during the movement of the valve member from its non-dispensing position to its dispensing position. This is accomplished by making the annular extension axially thicker at its innermost extent than at its outermost extent, to thereby make an outer region of the annular extension sufficiently flexible to permit the valve member to be inserted through the spout of the cap into its assembled relationship with the cap.

The dispensing closure of the present invention is intended for application to a container for the packaging of a comestible liquid, for example, for the packaging of a sport drink or other still or non-carbonated beverage, and the interference fit between the valve member and the cap makes such a dispensing closure suitable for a container intended for the packaging of a comestible product that is normally consumed in a multitude of small doses. In any case, as a dispensing closure intended for application to a container for a comestible product, the dispensing closure of the present invention is provided with structure to impart tamper-indicating opening characteristics thereto, both as to the attachment of the cap to the container and as to the relationship between the valve member and the cap in the original, non-dispensing position of the valve member.

Accordingly, it is an object of the present invention to provide an improved, two-piece dispensing valve for application to the neck of a container. More particularly, it is an object of the present invention to provide an improved two-piece dispensing closure with structure to help to prevent inadvertent disengagement of the separate pieces of the two-piece container during movement of the separate pieces relative to one another to permit dispensing through the dispensing container. It is also an object of the present invention to provide a dispensing closure as described above with tamper-indicating opening characteristics.

For a further understanding of the present invention and the objects thereof, attention is directed to the drawing and to the following brief description thereof, to the detailed description of the preferred embodiment and to the appended claims.

DETAILED DESCRIPTION OF THE PREFERRED EMBODIMENT

Figure 1:
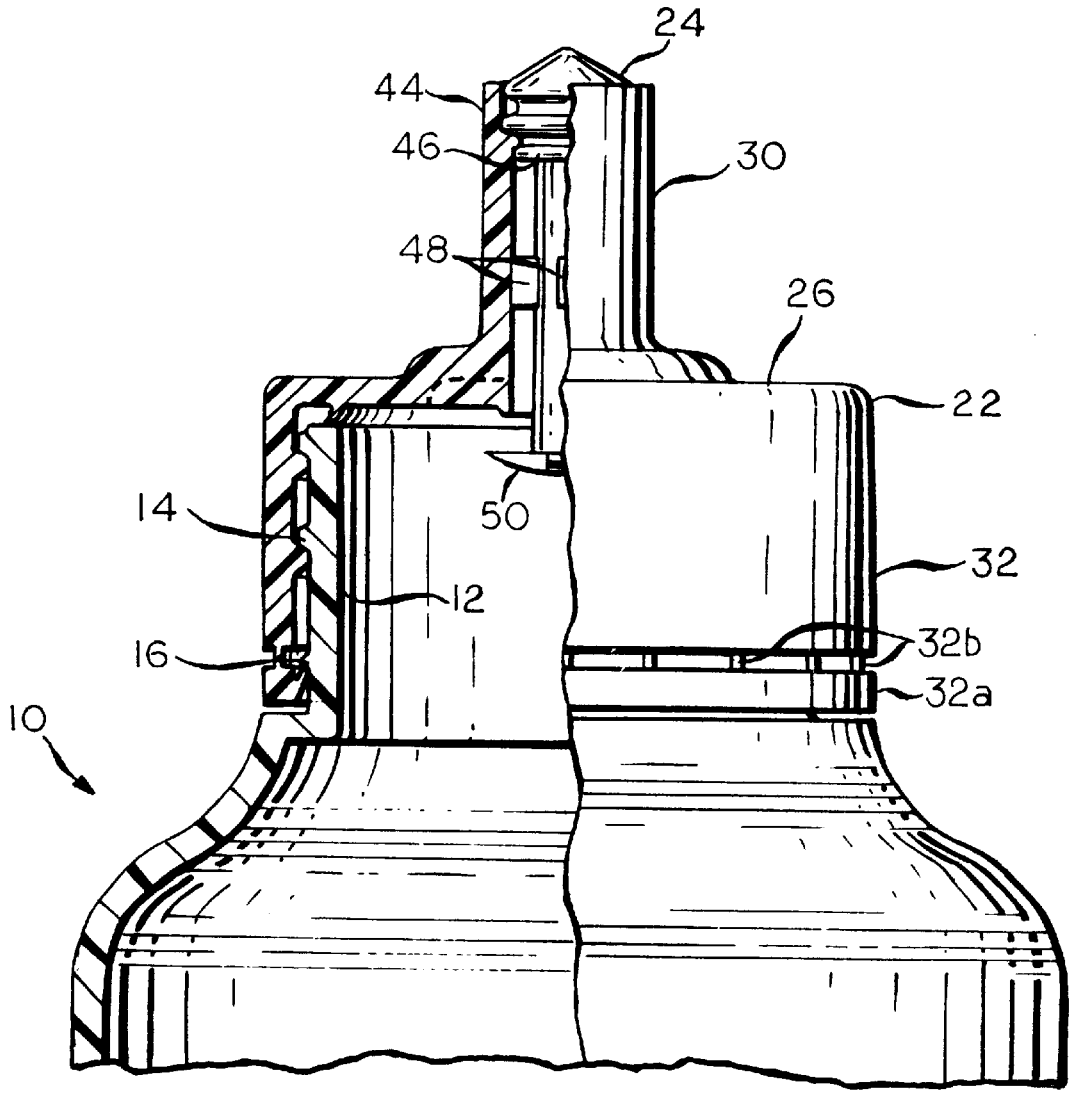
FIG. 1 is a fragmentary view, partly in cross-section, of a dispensing closure according to the present invention in assembled relationship to the neck of a container.

A closure according to the preferred embodiment of the present invention is indicated generally by reference numeral 20 in the drawing. The closure 20 is shown in FIG. 1 as being applied to the neck of an associated bottle or other container, identified generally by reference numeral 10, such as a blown plastic container or a glass container. The closure 20 is made up of a cap member 22 and a separate valve member 24. The cap member 22 has a transversely extending top panel portion 26, and the top panel portion 26 is of annular configuration with an opening 28 positioned centrally within the top panel portion 26. The cap member 22 also has an annular spout 30, which circumscribes the opening 28 and extends axially away from the top panel portion 26, and an annular skirt 32 that extends axially from an outer edge of the top panel portion 26 and in a direction opposed to the direction of the extent of the annular spout 30 from the top panel portion 26. To permit the cap member 22 to be removably secured to a neck 12 of the container 10, the annular skirt 32 is provided with an inwardly projecting and helically extending thread 34, which permits the cap member 22 to engage an outwardly projecting and helically extending thread 14 on the neck 12 of the container 10.

To provide a tamper-indicating connection between the cap 22 and the container 10, a lowermost marginal portion 32*a* of the annular skirt 32, which is connected to the portion of the annular skirt 32 thereabove by a plurality of frangible bridges 32*b*, is provided with an annular, frustoconical flexible band 32*c*, and the flexible band 32*c* engages the underside of a locking bead 16 on a neck 12 of the container 10 when the cap 22 is securely applied to the container 10. Any attempt to remove the cap member 22 from the container 10 will, therefore, cause rupture of the frangible bridges 32*b* and separation of the lowermost portion 32*a* of the skirt 32 from the portion of the skirt 32 thereabove, to provide a visual indication of a prior removal or attempted removal of the cap member 22 from the container 10. This will thereby impart tamper-indicating characteristics to the juncture between the cap member 22 and the container 10. The cap member 22 also has a downwardly projecting conical sealing fin 36 projecting from the underside of the top panel portion 26 to sealingly engage a rim at the top of the neck 12 of the container 10. As thus far described, the cap member 22, including the top panel portion 26, the spout 30, the skirt 32, the helical thread 34 and the sealing fin 36, is preferably molded integrally in a single piece, for example, by compression molding or injection molding, from a suitable thermoplastic material, such as polypropylene or high density polyethylene.

Figure 2:
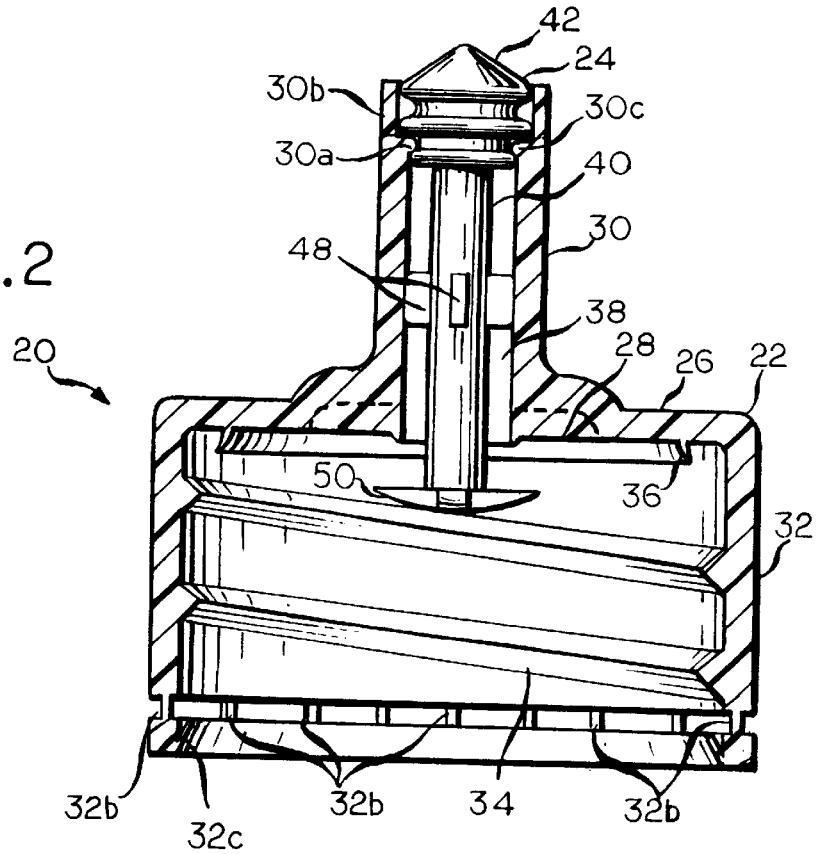
FIG. 2 is a sectional view, at an enlarged scale, of the dispensing closure of FIG. 1 in a non-dispensing condition of the closure.

The valve member 24, which is also molded integrally in a single piece from a suitable thermoplastic material, has an elongate central portion 40 which, when the valve member 24 and the cap member 22 are assembled as shown in the drawing, is positioned centrally within the interior of the spout 30 to provide an annular dispensing passage 38 to permit dispensing of the contents of the container 10 through the closure 20. The valve member 24 has an enlarged projection 42 at an outermost end to permit grasping of the valve member 24 by a user to reversibly move the valve member 24 between an innermost position, as shown in FIG. 1, and an outermost position, as shown in FIG. 2. In the innermost position of the valve member 24, a radially inwardly projecting bead 30*a* near the free end of the spout 30 of the cap member 22 is sealingly trapped between spaced apart annular beads 44, 46 near the free end of the valve member 24, to prevent dispensing of the contents of the container 10 through an annular dispensing passage 38 of the cap member 22. However, in the FIG. 2 position of the valve member 24, sealing engagement between the bead 30*a* and the beads 44, 46 is broken, to thereby permit dispensing of the contents of the container 10 through the annular dispensing passage 38. To ensure proper coaxial alignment between the valve member 24 and the spout 30 of the cap member 22, the central portion 40 of the valve member 24 is provided with a plurality of circumferentially spaced apart and radially extending fins 48, the radial extent of which is sized to fit snugly within the interior of the spout 30.

To provide tamper-indicating characteristics between the cap member 22 and the valve member 24, an outermost free end 30*b* of the spout 30 of the cap member 22 is in the form of a heat shrinkable band which, after shrinking, engages the bead 44 of the valve member 24 in an interference fit when the valve member 24 is in its FIG. 2, non-dispensing position. To permit the valve member to be moved to its FIG. 3 position, the free-end 30*b* of the spout 30 must first be torn away, in the manner of the removal of the tamper band from a plastic closure of the type widely used in the packaging of milk, to thereby provide a visual indication of the removal or attempted removal of the free end 30*b* from the cap member 22.

Figure 3:
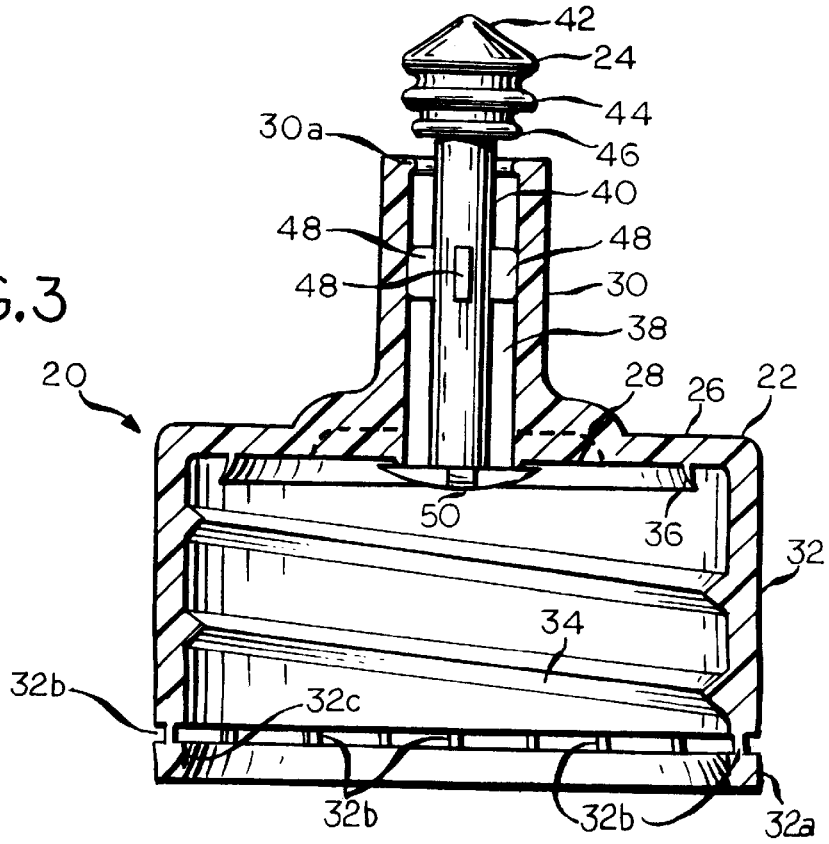
FIG. 3 is a view, like FIG. 2, showing the dispensing closure of the present invention in its dispensing position.

To prevent inadvertent removal or disengagement of the valve member 24 from the cap member 22 upon the movement of the valve member 24 from its FIG. 2 position to its FIG. 3 position, an innermost free end of the valve member 24 is provided with an annular extension 50 whose radial extent is greater than the radial extent of the interior of the spout 30. The annular extension 50 is configured as a wheel with a continuous rim and radial spokes to provide spaces for the flow of product therethrough, and is thicker in its center than at its exterior, for example, by constructing it in part-spherical configuration, as shown, to provide its outer extent with sufficient flexibility to permit insertion of the valve member 24 through the spout 30 into the FIG. 2 position of the valve member 24 relative to the cap member 22. The annular extension 50 will, however, then have an interference fit with the annular spout 30 of the cap 22 to make it difficult to manually extract the valve member 24 from the cap member 22.

As described, the valve member 24, including the central portion 40, the enlarged projection 42, the annular beads 44, 46, the fins 48 and the annular extension 50, is preferably molded integrally in a single piece from a suitable thermoplastic material, such as polypropylene or high density polyethylene, for example, by injection molding.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. A two-piece dispensing closure for a liquid container, said closure comprising:

a molded plastic cap member having an annular skirt for engaging a neck of the container, an annular top panel extending transversely of said annular skirt, and an annular spout extending axially from said top panel in a direction opposed to the direction that said annular skirt extends from said annular top panel, said molded plastic cap member, including said annular skirt, said annular top panel and said annular spout being molded integrally in a single piece; and a molded plastic valve member being telescopically positioned within said annular spout of said molded plastic cap member, said valve member blocking flow of liquid from the container through an annulus between said valve member and said spout at an innermost position of said valve member and permitting flow of liquid from the container through the annulus at an outermost position of said valve member, said valve member having an enlarged annular extension at an innermost end of said valve member to help prevent extraction of said valve member from said molded plastic cap member upon movement of said valve member from the innermost position of said valve member to the outermost position of said valve member.

2. A closure according to claim 1 and further comprising:

means cooperative between said molded plastic cap member and said molded plastic valve member for providing a visual indication of the movement or attempted movement of said valve member from the innermost position of said valve member to the outermost position of said valve member.

3. A dispensing closure according to claim 1 wherein:

said valve member has an elongate central portion, and further comprises;

a circumferentially spaced apart plurality of radially extending fins extending from said central portion to maintain said valve member axially aligned with said spout of said cap member.

4. A dispensing closure according to claim 1 wherein:

said spout of said cap member has a radially inwardly projecting bead near a free end thereof; and said valve member has a spaced apart plurality of radially outwardly extending annular beads near a free end thereof;

said spaced apart annular beads of said valve member sealingly engaging said radially inwardly extending bead of said spout of said cap member in the innermost position of said valve member with respect to said cap member.

5. A dispensing closure according to claim 1 wherein said annular skirt comprises:

a flexible band molded integrally with said cap member and extending conically from a lowermost free end of said cap member upwardly and inwardly with respect to said annular skirt of said cap member to engage an annular bead on the liquid container to provide tamper-indicating opening characteristics between said dispensing closure and the container upon the first removal or attempted removal of the dispensing closure from the liquid container.

6. A dispensing closure according to claim 1 wherein said top panel of said cap member comprises:

an annular sealing fin extending downwardly and outwardly from an underside of said top panel to sealingly engage a rim of the liquid container when said dispensing closure is removably applied to the liquid container.

7. A package comprising, in combination:

a container having a neck surrounding an opening and means projecting outwardly from said neck for permitting a closure to be affixed to said neck; and a two-piece dispensing closure affixed to said neck of said container, said two-piece dispensing closure comprising;

a molded plastic cap member having an annular skirt engaging said neck of said container, an annular top panel extending transversely of said annular skirt, and an annular spout extending axially from said top panel in a direction opposed to the direction that said annular skirt extends from said annular top panel, said molded plastic cap member, including said annular skirt, said annular top panel and said annular spout being molded integrally in a single piece, and a molded plastic valve member being telescopically positioned within said annular spout of said molded plastic cap member, said valve member blocking flow of liquid from the container through an annulus between said valve member and said spout at an innermost position of said valve member and permitting flow of liquid from the container through the annulus at an outermost position of said valve member, said valve member having an enlarged annular extension at an innermost end of said valve member to help prevent extraction of said valve member from said molded plastic cap member upon movement of said valve member from the innermost position of said valve member to the outermost position of said valve member.

8. A package according to claim 7 wherein said two-piece dispensing closure further comprises;

means cooperative between said molded plastic cap member and said molded plastic valve member for providing a visual indication of the movement or attempted movement of said valve member from the innermost position of said valve member to the outermost position of said valve member.

9. A package according to claim 7 wherein:

said valve member of said two-piece dispensing closure has an elongate central portion and further comprises;

a circumferentially spaced apart plurality of radially extending fins extending from said central portion to maintain said valve member axially aligned with said spout of said cap member.

10. A package of claim 7 wherein:

said spout of said cap member has a radially inwardly projecting bead near a free end thereof; and said valve member has a spaced apart plurality of radially outwardly extending annular beads near a free end thereof;

said spaced apart annular beads of said valve member sealingly engaging said radially inwardly extending bead of said spout of said cap member in the innermost position of said valve member with respect to said cap member.

11. A package according to claim 7 wherein said annular skirt of said cap member of said two-piece dispensing closure comprises;

a flexible band molded integrally with said cap member and extending conically from a lowermost free end of said outer member upwardly and inwardly with respect to said annular skirt of said cap member to engage an annular bead on the liquid container to provide tamper-indicating opening characteristics between said dispensing closure and the container upon the first removal or attempted removal of the dispensing closure from the liquid container.

12. A package according to claim 7 wherein said top panel of said cap member of said two-piece dispensing closure comprises;

an annular sealing fin extending downwardly and outwardly from an underside of said top panel and sealingly engaging a rim of said liquid container.

* * * * *